US009533513B1

(12) United States Patent
Qian

(10) Patent No.: US 9,533,513 B1
(45) Date of Patent: Jan. 3, 2017

(54) PRINT ALIGNMENT IN A BIDIRECTIONAL SCANNING PRINT SYSTEM

(71) Applicant: Hewlett-Packard Development Company, L.P., Houston, TX (US)

(72) Inventor: Li Qian, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/817,636

(22) Filed: Aug. 4, 2015

(51) Int. Cl.
*B41J 2/21* (2006.01)
*B41J 19/14* (2006.01)
*B41J 29/393* (2006.01)

(52) U.S. Cl.
CPC ..... *B41J 2/2135* (2013.01); *B41J 2/2132* (2013.01); *B41J 19/142* (2013.01); *B41J 19/145* (2013.01); *B41J 29/393* (2013.01)

(58) Field of Classification Search
CPC ..... B41J 2/2135; B41J 2029/3935
See application file for complete search history.

(56) References Cited

U.S. PATENT DOCUMENTS 6,164,749 A 12/2000 Williams
6,880,909 B2 4/2005 King et al.
7,021,732 B2 4/2006 Folkins
7,443,535 B2 10/2008 Ishibashi
8,147,019 B2 4/2012 Fujita et al.
8,506,038 B2 8/2013 Mizes et al.
8,939,536 B2 1/2015 Smith
2003/0048460 A1* 3/2003 Vinals-Matas et al. ... B41J 3/01 358/1.8
2007/0291059 A1* 12/2007 Hayashi et al. ..... B41J 19/145 347/12

OTHER PUBLICATIONS

Adobe, Printing Images to a Commercial Printing Press [online], Feb. 1, 2001 [retrieved on Jun. 19, 2015], Retrieved from the Internet: < URL: https://helpx.adobe.com/photoshop/using/printing-images-commercial-printing-press.html >.
Hewlett-Packard Development Company, L.P., HP Latex 3000 Printer User's Guide, 2014 (312 pages).

* cited by examiner

*Primary Examiner* — Kristal Feggins
*Assistant Examiner* — Kendrick Liu
(74) *Attorney, Agent, or Firm* — HP Inc.

(57) ABSTRACT

A system, method and non-transitory computer readable medium for testing the alignment of a bidirectional scanning print system are described. A first swathe is printed in first direction, and a second swathe is printed after the first in a second direction along a print axis. Each swathe comprises a plurality of printed blocks aligned along the print axis, separated by unprinted bars. Misalignment in the print system can be identified from the print output.

19 Claims, 4 Drawing Sheets

PRINT ALIGNMENT IN A BIDIRECTIONAL SCANNING PRINT SYSTEM

BACKGROUND

Print systems are arranged to output a printed image onto a suitable print substrate. Certain print systems are arranged to move a print substrate in a media transport direction, whilst a printhead scans orthogonally to the media transport direction along a print axis. A bidirectional scanning print system incorporates a print mechanism that moves a printhead in both directions along the print axis so as to scan back and forth across the print substrate. In a print system, it is desired to obtain good image quality by minimizing dot placement error and thus reducing image artifacts such as grain and banding.

BRIEF DESCRIPTION OF THE DRAWINGS

Various features of certain examples will be apparent from the detailed description which follows, taken in conjunction with the accompanying drawings, which together illustrate, by way of example only, a number of features, and wherein.

DETAILED DESCRIPTION

Figure 1:
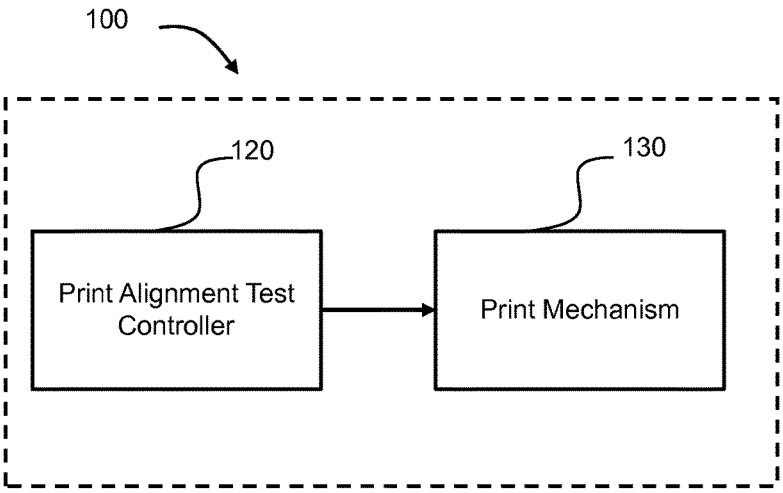
FIG. 1 is a schematic diagram of a print system according to an example.

In the following description, for purposes of explanation, numerous specific details of certain examples are set forth. Reference in the specification to "an example" or similar language means that a particular feature, structure, or characteristic described in connection with the example is included in at least that example, but not necessarily in other examples.

Certain examples described herein relate to print systems. A print system may include a printer, and in certain cases, the printer may be an inkjet printer. Furthermore, certain examples may relate to scanning print systems, in which a printhead moves laterally back and forth relative to a print substrate along the scan/print axis. These scanning print systems may comprise bidirectional scanning print systems which are able to print in both the forwards and backwards scanning directions. Certain examples described herein relate to calibrating a printhead in a print system so as to modify its print output. Printhead calibration correctly aligns the relative forwards and backwards print outputs produced by the printhead.

In printing terminology, a width of printed portion that a print mechanism can create across a print substrate in one go is known as a "swathe". In a page-wide-array printing system, a static set of printheads may extend across a complete width of the print substrate. In a scanning print system, as described in examples herein, a printhead narrower than the width of the print substrate may be employed. In this case the printhead is transported back and forth across the width of the print substrate, e.g. by a moveable carriage. In both cases, the print substrate may be moved orthogonally relative to the printhead (e.g., in a media transport direction) to complete a print job.

A bidirectional scanning print system is able to print in both the forwards and backwards directions as the printhead scans across the width of the print substrate. However, owing to variables such as the thickness of the print substrate, the distance between the print substrate and the printhead, and/or the scanning speed of the scanning printhead, it can be easy for swathes printed in the forwards and backwards scanning directions to become misaligned, leading to inaccurate ink dot placement and image artifacts in print outputs. Certain examples described herein enable a print system to be calibrated and a print mechanism correctly aligned to ensure that the print system compensates for different printing conditions in the forwards and backwards scanning directions. This in turn provides accurate ink dot placement.

Certain examples described herein enable calibration of a print mechanism by printing a print alignment test pattern onto a print substrate. The print alignment test pattern comprises multiple elements, some of which are exclusively printed by the printhead in a forwards scanning direction, and some of which are exclusively printed by the printhead in a backwards scanning direction. By analysing any discrepancy between the forwards and backwards scanning print sections, the extent of any misalignment present in the print system may be calculated, and the print system may be re-calibrated accordingly in order to reduce, and in some instances even to eliminate, the misalignment.

FIG. 1 shows a bidirectional scanning print system 100 according to an example. The print system 100 comprises a print alignment test controller 120 and a print mechanism 130. The print mechanism 130 is arranged to print a swathe in both a first and second direction along a print axis, for example, the first and second directions being opposite directions along the print axis. In another example, the print system 100 may comprise an actuator to translate a printhead across an extent of a print substrate to print a swath. A constrained movement path of the printhead may form the print axis, e.g. this may be across the width of the print substrate. The print alignment test controller 120 provides instructions to the print mechanism 130 so that the print mechanism 130 can execute printing the print alignment test pattern onto a print substrate.

In the example of FIG. 1, the print alignment test controller may instruct the print mechanism to print a first swathe on a print substrate in the first direction and instruct the print mechanism to print a second swathe adjacent to the first swathe on the print substrate in the second direction. The print alignment test controller 120 may comprise an embedded processor of a print system arranged to generate instructions for the print mechanism. In one case, instructions may be generated based on machine readable instructions retrieved from a machine readable memory, e.g. an embedded memory of the print system. In the present example, the first and second swathes respectively comprise first and second portions of a Vernier scale pattern. A Vernier scale pattern comprises two rows, an upper and a lower scale, one above the other. Each row comprises parallel markers spaced apart from each other along the scale. The Vernier scale pattern is arranged so that the markers along one row are differently spaced by a known amount to the markers along the other row. For example, the space between the upper markers may be a pixel greater than the space between the lower markers. In another example, the upper row spacing maybe a fixed fraction of the lower row spacing, e.g. nine tenths. Therefore, for any relative lateral positioning of the upper and lower rows, only one pair of markers will (closely) align. Given the known discrepancy between the upper and lower marker spacing, identifying the most closely aligned marker pair provides a measure of any misalignment between the top and bottom rows. In the present example, the printing of the swathes may be instructed based on a print test pattern stored in machine readable memory. The swathes are instructed such that each swathe comprises a plurality of printed blocks aligned along the print axis. Each printed block in each swathe is of at least a first width. In certain cases, all blocks along a single swathe are of a set width W1. The plurality of blocks are separated by unprinted sections of at least a second width. In certain cases, all the gaps are of a set width W2. In the present example, the first width is greater than the second width, e.g. W1>>W2. An example ratio of widths is 10:1 (e.g. W1:W2); in general a ratio of widths is selected such that an alignment of the gaps is detectable (e.g. ranges above 2:1 may be useable). For example, across at least a portion of a width of a print substrate, e.g. aligned with the print axis, a swathe may comprise a repeated pattern of horizontal colored segments separated by, e.g. horizontally divided by, narrow, e.g. in relation to the width of the segments, vertical segments.

By printing swathes of a test pattern that has larger printed sections followed by shorter unprinted sections, a measurement of alignment may be more easily made, and/or nozzles of the printhead may be cleared (e.g. by way of printing the blocks), thus in at least some instances alleviating the need for other separate test procedures to configure the printhead.

Figure 2:
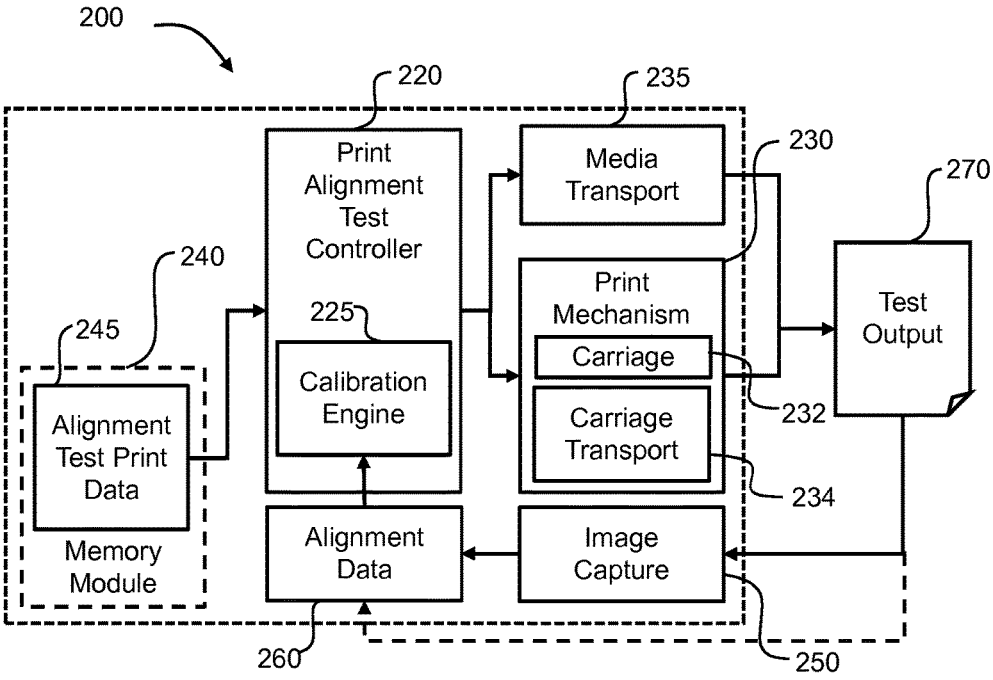
FIG. 2 is a more detailed schematic diagram of a print system according to an example.

FIG. 2 shows a more detailed view of a print system 200. The print system 200 comprises a print alignment test controller 220 and print mechanism 230. As in the earlier example, the print alignment test controller 220 provides instructions to the print mechanism 230 so that the print mechanism 230 may produce a print alignment test output 270. The output 270 may comprise a Vernier scale pattern as detailed herein. The print system 200 also comprises a media transport mechanism 235 which may be used to convey a print substrate along a media transport axis relative to the print mechanism 230. The media transport axis may be, for example, orthogonal to the scanning/print axis of the printing mechanism 230. The media transport mechanism 235 is also instructed by the print alignment test controller 220 so that the print substrate is moved along the media transport axis by the correct distance, in the correct direction, at the correct time. In this example, in-between instructing the print mechanism 230 to print the first and second swathes, the print test controller 220 may instruct the media transport mechanism 235 to move the print substrate relative to the print mechanism 230. Thus the print test controller 220 moves the print substrate such that the two swathes, forming two rows of print output, abut in a direction perpendicular to the first and second scanning directions, e.g. are adjacent in a media transport direction.

The print system 200 may also comprise a memory module 240 which may store alignment test print data 245 that may be used to construct the print alignment test output 270. The print alignment test controller 220 may retrieve the alignment test print data 245 from the memory module 240 and instruct the print mechanism 230 and media transport mechanism 235 in order to produce the print alignment test output 270, e.g. to print the first and second swathes.

The print alignment test controller 220 may also comprise a calibration engine 225 which may receive alignment data 260 gathered from the print alignment test output 270. The calibration engine 225 subsequently calibrates the print mechanism 230 to correct any misalignment between the forwards and backwards print outputs and ensure accurate ink dot placement. This may be achieved by shifting print data for a swathe in at least one of the backwards and forwards printing/scanning directions by a certain number of pixels.

The calibration of the print system may be achieved either manually, involving input of measurement data from an end user, or automatically, wherein the calibration is carried out by the print system. The example of FIG. 2 shows certain components of an automatic setup. In this case, the print 200 also comprises an image capture device 250. The image capture device 250 captures image data from the print alignment test output 270. For example, the image capture device 250 may comprise a charge-coupled device (CCD) arranged to capture an image of the printed test pattern on the print substrate. This image, and/or a processed version of this image, is supplied to the calibration engine 225 as alignment data 260. In an example of a manually calibrated print system, the end user may examine the print alignment test output 270 and calculate the alignment data 260 (as indicated by the dotted line from the print alignment test output 270 to alignment data 260). In this case, the alignment data 260 is then inputted by the end user directly into the calibration engine 225. Methods of misalignment calculation are covered in more detail later on.

In a case where the alignment data 260 comprises an output from the image capture device 250, the calibration engine 225 is configured to receive the image from the image capture device, identify the unprinted sections in the image, and obtain alignment data based on an alignment of at least one identified unprinted section from the first swathe and at least one identified unprinted section from the second swathe. For example, the calibration engine 225 may apply at least one image processing function to identify the unprinted gaps and determine at least one set of gaps that are aligned across the first and second (or upper and lower) swathes.

In one case, the print mechanism 230 may further comprise a carriage 232 and carriage transport mechanism 234. The carriage 232 may receive a removable printhead to expel ink onto the print substrate, and the carriage transport mechanism 234 being arranged to translate the carriage 232 and an attached printhead forwards and backwards across the print substrate along the scanning axis. If the print system 200 is arranged to print across the width of a print substrate then the carriage transport mechanism 234 is arranged to move the carriage across a width of the print substrate.

Figure 3:
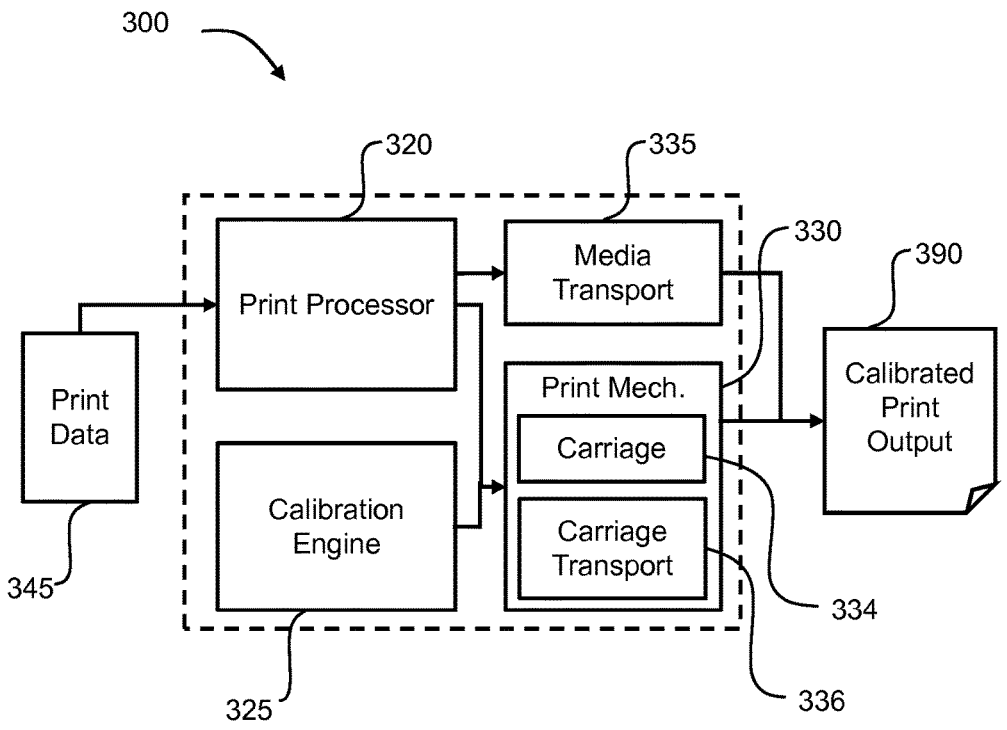
FIG. 3 is a schematic diagram of a print system according to an example.

FIG. 3 shows an example print system 300 having already run a print alignment test as described previously. The print system 300 may comprise a print processor 320, a print mechanism 330 and media transport mechanism 335. The print mechanism 330 may comprise a carriage 334 and carriage transport system 336. The print system also comprises a calibration engine 325. The print processor 320 receives print data 345 and provides instructions to both the media transport mechanism 335 and the print mechanism 330 to generate a print output. In addition to the print processor 320 providing instructions to the media transport mechanism 335 and the print mechanism 330, the calibration engine 325, having already received alignment data 260, provides additional information to the print mechanism to ensure that the printing in both the forwards and backwards scanning directions are correctly aligned. This may be achieved by shifting print data for a swathe in at least one of the backwards and forwards printing/scanning directions by a certain number of pixels. The combination of instructions from the print processor 320 and calibration engine 325 result in a calibrated print output 390.

Figure 4:
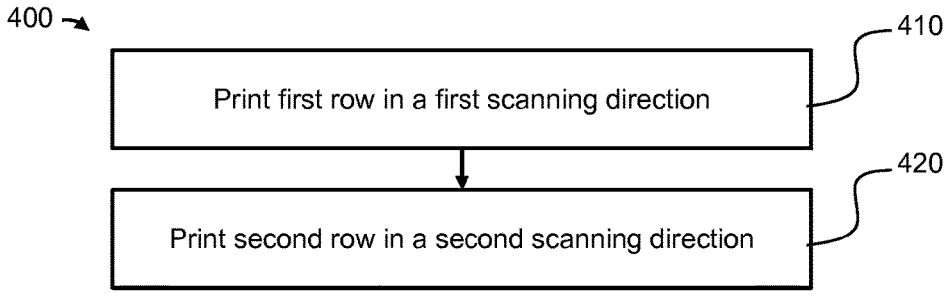
FIG. 4 is flow diagram showing a method of testing print alignment according to an example.

FIG. 4 shows a flow diagram of an example method of testing the print alignment of a bidirectional scanning print system. The method 400 comprises printing a first row in a first scanning direction 410 and printing a second row relative to the first row in a second scanning direction 420. In certain cases, block 410 may comprise instructing a print mechanism to print a first row of a predefined calibration pattern, and subsequently instructing the same mechanism to print a second row of the predefined calibration pattern, such that they are contiguous on a print substrate. In this example, the first and second printed rows may describe a Vernier scale pattern (discussed in more detail further on). Each row comprises a plurality of continuous printed blocks of at least a first width in the first and second scanning directions. These printed blocks are divided from each other by unprinted gaps of at least a second width in the first and second scanning directions. The first width is greater than the second width. In certain cases, the printed blocks are of a single color. This may aid determination of misalignment, e.g. via image capture. Any print misalignment present between the backwards and forwards scanning directions may be recognized and measured from the combination of the backwards and forwards print swathes.

In certain cases, the method comprises obtaining an alignment measurement using the Vernier scale pattern, and recalibrating the print system using the alignment measurement. In one implementation, the method may comprise capturing a digital image of the print alignment test output comprising the first and second printed rows. From this, the method may comprise determining the level, if any, of the printhead misalignment between the forwards and backwards scanning/printing directions. In certain cases, the method may comprise receiving alignment data from a user, e.g. as well as or instead of capturing an image of a print output.

Figure 5:
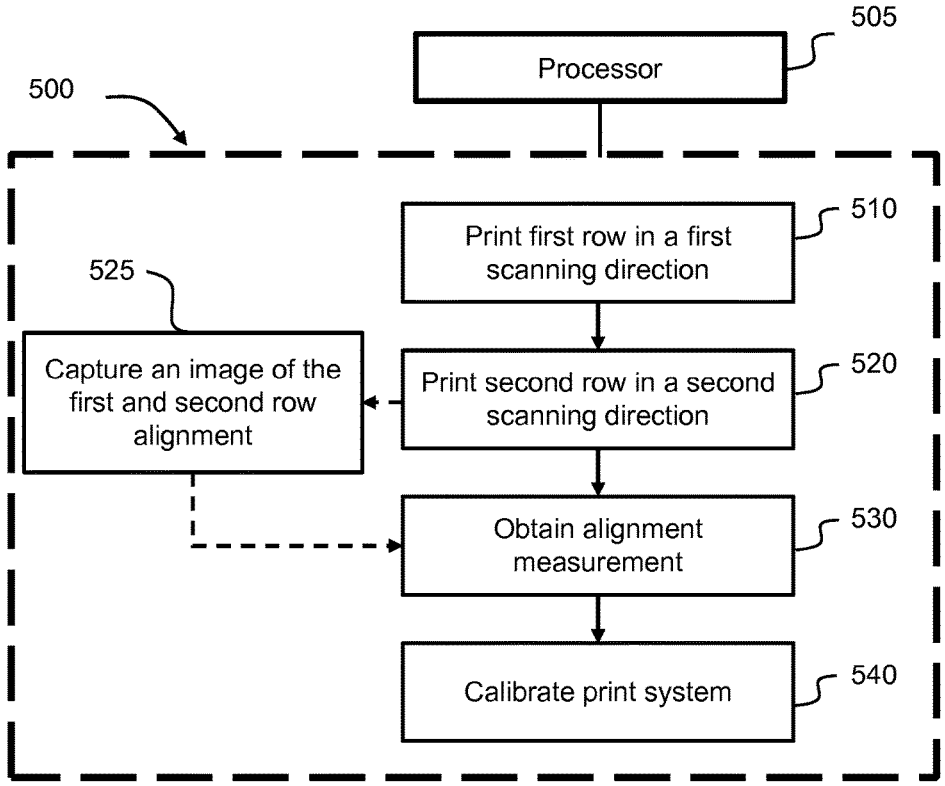
FIG. 5 is diagram showing a non-transitory computer readable medium comprising instructions according to an example.

FIG. 5 shows a non-transitory computer readable medium 500 comprising machine readable instructions which when executed by a processor 505 cause the processor 505 to carry out a print test operation. The processor may form part of a bidirectional printing system, e.g. may form part of the print alignment test controller shown in FIGS. 1 and 2. In FIG. 5, a first instruction 510 may cause the processor to instruct a bidirectional scanning print system to print a first row of printed segments of a print alignment test pattern on a print substrate in a first scanning direction. Said printed segments are of a first width and separated by gaps of a second width, the first width being greater than the second width. A second instruction 520 may then cause the processor to instruct the bidirectional scanning print system to print a second row of said printed segments adjacent to the first row on the print substrate, in a second scanning direction opposite to the first scanning direction. This then may result in a print output on the print substrate containing the print alignment test pattern.

At a time following the execution of the first two instructions 510 and 520, two subsequent instructions may cause the processor to calibrate the bidirectional scanning print system. A third instruction 530 may cause the processor to obtain an indication of an alignment of at least one gap in the first row and at least one gap in the second row. A fourth instruction 540 may cause the processor to calibrate the bidirectional scanning print system based on the obtained indication of the alignment.

FIG. 5 also shows an instruction that may be applied in one example to obtain the indication of the alignment. Instruction 525 may cause the processor to obtain an image of the print alignment test pattern comprising the first and second printed rows. This may be used to obtain the indication of alignment, e.g. using one or more image processing functions.

Figure 6:
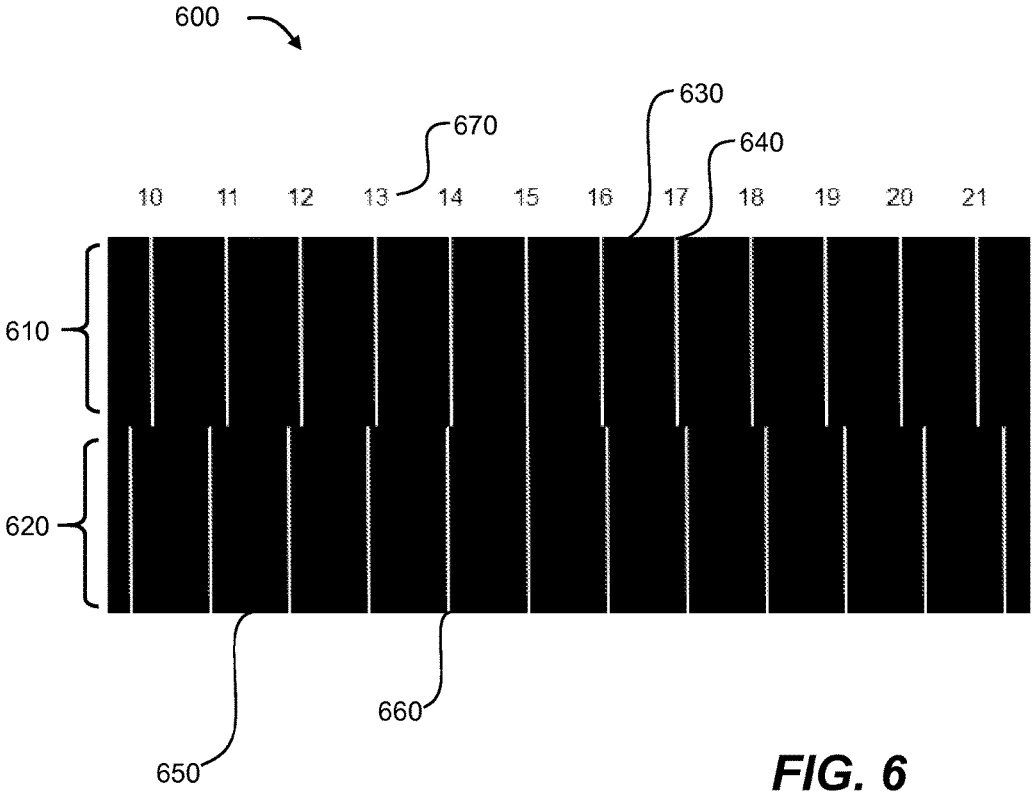
FIG. 6 is a print output according to an example.

FIG. 6 is an example print alignment test pattern 600 as may be generated by applying certain other examples discussed herein. The pattern 600 includes two rows 610, 620 aligned along the scanning axis of the print system, printed one atop the other. This scanning axis, e.g. an axis along which a printhead is moved, may be parallel with a print axis, e.g. an axis along which printing occurs. One row, in this example top row 610, is printed in a first scanning direction (e.g. forwards) whilst the remaining row, in this example bottom row 620, is printed in a second scanning direction (e.g. backwards). In other examples, a top row may relate to a backwards scan and a bottom row may relate to a forwards scan. In the present example, the two rows combine to form a Vernier scale pattern.

Each row 610, 620 comprises multiple printed block regions 630, 650 of a first width, and separated from each other by unprinted bar regions 640, 660 of a second width. In the present example, the printed blocks 630, 650 are broad compared to the relatively narrow unprinted bars 640, 660. Each narrow unprinted bar 640 on the upper row 610 has a corresponding (although not necessarily aligned) narrow unprinted bar 660 on the lower row 620. Each pair of upper 640 and lower narrow bars 660 are labelled by a number 670.

The narrow unprinted bars 640, 660 on both the first/top 610 and second/bottom 630 rows are of equal width. The printed blocks 630 on the first/Lop row 610 are of a fixed and known width. The printed blocks 650 on the second/bottom row 620 are of a fixed and known width and either slightly broader or slightly narrower than the width of the first/upper printed blocks 630. In the example shown in FIG. 6, the second/lower blocks 650 are wider than the first/upper blocks 630 by one pixel width. Owing to the discrepancy between the first 630 and second 650 printed block widths, the first/upper and corresponding second/lower unprinted bars 640, 660 do not align fully with each other across the width of the rows, and diverge from each other.

By knowing the width difference between the first/upper 630 and second/lowed 650 printed blocks, and the point at which the narrow bars 640, 660 of the first/upper 610 and second/lower 620 rows most closely align in the original print data 245 it may be possible to calculate the level of a misalignment of a print mechanism between a first and second scanning/printing direction simply by identifying the point at which the narrow bars 640, 660 of the first/upper 610 and second/lower 620 rows most closely align in the print alignment test output 270. This label value 670 may be used as the alignment data 260, and by entering the label value 670 into the calibration engine 225, 325 any misalignment between the forwards and backwards scanning directions can be corrected by advancing or delaying firing when printing.

In the present example, the alignment test print data 245 retrieved by the print alignment test controller 220 arranged the first/upper 610 and second/lower 620 rows so that the narrow bars 640, 660 labelled "20" are aligned. In one example, an aligned printhead reproduces the alignment test data 245 correctly without any calibration of the printhead, and the print alignment test output 270 produces a print alignment test pattern where the narrow unprinted bars labelled "20" are aligned. However, as seen in the example output 600 in FIG. 6, the first/upper and second/lower 640,660 narrow bars at point "20" are no longer aligned, thus demonstrating a printhead misalignment between the first print/scanning direction and the second print/scanning direction. Instead, the first/upper 610 and second/lower 620 rows are (most closely) aligned at point labelled "15". Since in this example it is known that the second/lower blocks 650 are wider than the first/upper blocks 630 by one pixel width, it is clear that the second/lower 620 row is a total of 5 pixels misaligned (in the example shown in FIG. 6, to the right) from the upper row 610. Therefore, in one example, if left uncorrected, the forwards scanning direction printing and backwards scanning direction printing may not align by 5 pixels width. However, by entering the alignment data 260 into the calibration engine 225, 325, the print mechanism 230, 330 may be calibrated to redirect any printing in the backwards scanning direction 5 pixels to the left of the original target. This may be achieved through advancing or delaying of the firing mechanism in the printhead.

Certain print alignment test and calibration methods as discussed herein have a useful effect of reducing "decap" issues. "Decap" relates to the length of time that the ink nozzles can remain uncovered and idle before they begin to fail. The use of the print alignment test pattern may help reduce "decap" issues, by ensuring the printheads are firing more often, thus reducing their operational downtime, i.e. the use of printed blocks purges the nozzles with ink allowing them to operate properly again. Bad batches of ink, a problem outside of the user's control, are often more prone to "decap" issues, and the present method helps make the alignment more robust by reducing the idle time of the nozzles, even when bad ink batches are employed.

Also, use of the described print alignment test pattern may help reduce the need for "spit bars". "Spit bars" are ink collectors into which ink may be printed to purge ink from failing nozzles, e.g. purge any dried ink into the ink collectors which may be off to the side of the print substrate. However, incorporating spit bars may result in expanding the scan distance and will subsequently trigger increased swathe delay, and may also trigger memory corruption issue. However, due to the use of the print alignment test pattern described herein ink nozzles may be more active, and in at least one example there may be no need for purging ink into spit bars adjacent to the print substrate. This can thus conserve space within the print system. This has the knock-on effect of helping reduce swathe delay. Additionally, the colored blocks may be printed at a normal firing frequency for a standard print job (e.g. 6 kHz). By printing the test pattern at a proper firing frequency, the print alignment test output more accurately simulates real printing conditions and leads to more accurate calibration.

The preceding description has been presented to illustrate and describe examples of the principles described. This description is not intended to be exhaustive or to limit these principles to any precise form disclosed. Many modifications and variations are possible in light of the above teaching.

What is claimed is:

1. A bidirectional scanning print system comprising:

a print mechanism to print in first and second directions along a print axis; and a print alignment test controller to:

instruct the print mechanism to print a first swathe on a print substrate in the first direction; and instruct the print mechanism to print a second swathe adjacent to the first swathe on the print substrate in the second direction, wherein the first and second swathes respectively comprise first and second portions of a Vernier scale pattern, and wherein each swathe of the first and second swathes comprises a plurality of printed blocks aligned along the print axis, each block of the plurality of printed blocks in the first swathe being of a first width, the plurality of printed blocks in the first swathe being separated by unprinted sections each of a second width, the first width being greater than the second width.

2. The print system of claim 1, comprising:

a media transport mechanism to move the print substrate relative to the print mechanism, wherein the print test controller is to instruct the media transport mechanism to move the print substrate relative to the print mechanism between instructing the print mechanism to print the first and second swathes.

3. The print system of claim 1, comprising:

a memory accessible to the print alignment test controller to store alignment test print data for the first and second swathes, the print alignment test controller to retrieve the alignment test print data to instruct the print mechanism to print the first and second swathes.

4. The print system of claim 1, wherein each of the first and second swathes comprises printed blocks horizontally divided from each other by vertical gaps.

5. The print system of claim 1, wherein the print alignment test controller comprises:

a calibration engine to obtain alignment data based on determining alignment between unprinted sections in the first and second swathes, and calibrate the print mechanism based on the alignment data.

6. The print system of claim 5, comprising:

an image capture device to capture an image of the first and second swathes on the print substrate, wherein the calibration engine is to:

receive the image from the image capture device;

identify the unprinted sections in the image;

obtain the alignment data based on an alignment of an identified unprinted section from the first swathe and an identified unprinted section from the second swathe.

7. The print system of claim 5, wherein the calibration engine is to calibrate the print mechanism by shifting print data for a swathe in any of the first and second directions by a number of pixels determined based on the alignment data.

8. The print system of claim 1, wherein the print mechanism comprises:

a carriage to receive a printhead; and a carriage transport mechanism to move the carriage across a width of the print substrate.

9. A method for use in a bidirectional scanning print system, the method comprising;

printing, by a print mechanism in the bidirectional scanning print system, a first swathe on a print substrate in a first direction; and printing, by the print mechanism, a second swathe adjacent to the first swathe on the print substrate in a second direction, wherein the first and second swathes respectively comprise first and second portions of a Vernier scale pattern, and wherein each swathe of the first and second swathes comprises a plurality of printed blocks, each block of the plurality of printed blocks in the first swathe being of a first width, the plurality of printed blocks in the first swathe being separated by unprinted sections each of a second width, the first width being greater than the second width.

10. The method of claim 9, comprising;

obtaining an alignment measurement using the Vernier scale pattern of the printed first and second swathes, and calibrating the print mechanism using the alignment measurement.

11. The method of claim 10, wherein obtaining the alignment measurement comprises capturing an image of the Vernier scale pattern after printing the first and second swathes.

12. The method of claim 9, wherein the first and second swathes abut in a direction perpendicular to the first and second directions.

13. The method of claim 9, wherein the printed blocks in the first and second swathes are of a single color.

14. The method of claim 9, further comprising:

obtaining, by a calibration engine, alignment data; and calibrating, by the calibration engine, the print mechanism based on the alignment data.

15. The method of claim 14, further comprising:

capturing, by an image capture device, an image of the first and second swathes on the print substrate;

receiving, by the calibration engine, the image from the image capture device;

identifying, by the calibration engine, the unprinted sections in the image;

obtaining, by the calibration engine, the alignment data based on an alignment of an identified unprinted section from the first swathe and an identified unprinted section from the second swathe.

16. The method of claim 14, wherein the calibrating comprises shifting print data for a swathe in at least one of the first and second directions by a number of pixels determined based on the alignment data.

17. A non-transitory machine readable medium comprising instructions which, when executed by a processor, cause the processor to:

instruct a print mechanism in a bidirectional scanning print system to print a first swathe on a print substrate in a first direction;

instruct the print mechanism to print a second swathe adjacent to the first swathe on the print substrate in a second direction, wherein the first and second swathes respectively comprise first and second portions of a Vernier scale pattern, and wherein each swathe of the first and second swathes comprises a plurality of printed blocks, each block of the plurality of printed blocks being of at least a first width, the plurality of printed blocks being separated by unprinted sections each of at least a second width, the first width being greater than the second width;

determine a misalignment between an unprinted section of the unprinted sections in the first swathe with respect to an unprinted section of the unprinted sections in the second swathe; and calibrate the print mechanism based on the determined misalignment.

18. The non-transitory machine readable medium of claim 17, wherein the instructions when executed cause the processor to:

receive, from an image capture device, an image of the first and second swathes on the print substrate;

receive the image from the image capture device;

identify the unprinted sections in the image;

wherein the determined misalignment is based on the identified unprinted sections in the image.

19. The non-transitory machine readable medium of claim 18, wherein the instructions to cause the processor to calibrate comprise instructions to cause the processor to shift print data for a swathe in any of the first and second directions by a number of pixels determined based on the determined misalignment.

* * * * *